US009546075B2

(12) United States Patent
Sederholm et al.

(10) Patent No.: US 9,546,075 B2
(45) Date of Patent: Jan. 17, 2017

(54) SLIDING GUIDE SHOE AND AN ELEVATOR PROVIDED WITH A SLIDING GUIDE SHOE

(71) Applicant: KONE Corporation, Helsinki (FI)

(72) Inventors: Heidi Sederholm, Helsinki (FI); Matti Räsänen, Hyvinkää (FI); Osmo Björni, Hyvinkää (FI); Raimo Pelto-Huikko, Vantaa (FI); Jussi Salminen, Riihimäki (FI); Veijo Manninen, Rajamäki (FI)

(73) Assignee: KONE CORPORATION, Helsinki (FI)

( * ) Notice: Subject to any disclaimer, the term of this patent is extended or adjusted under 35 U.S.C. 154(b) by 566 days.

(21) Appl. No.: 13/743,113

(22) Filed: Jan. 16, 2013

(65) Prior Publication Data

US 2013/0126278 A1 May 23, 2013

Related U.S. Application Data

(63) Continuation of application No. PCT/FI2011/050659, filed on Jul. 15, 2011.

(30) Foreign Application Priority Data

Aug. 16, 2010 (FI) ..... 20105853

(51) Int. Cl.
*B66B 7/04* (2006.01)

(52) U.S. Cl.
CPC *B66B 7/047* (2013.01); *B66B 7/04* (2013.01)

(58) Field of Classification Search
CPC ..... B66B 7/047
USPC ..... 187/409
See application file for complete search history.

(56) References Cited

U.S. PATENT DOCUMENTS

| | | | | | |
|---|---|---|---|---|---|
| 3,032,377 | A * | 5/1962 | Blase | 187/409 |
| 3,363,383 | A * | 1/1968 | La Barge | 52/471 |
| 4,216,846 | A * | 8/1980 | Wheeler | 187/409 |
| 4,784,516 | A * | 11/1988 | Cox | 404/69 |
| 5,205,095 | A * | 4/1993 | Kessler | 52/208 |
| 6,491,468 | B1 * | 12/2002 | Hagen | 403/291 |
| 6,510,925 | B1 * | 1/2003 | De Jong | 187/409 |
| 2008/0053755 | A1 | 3/2008 | Lindberg | |
| 2010/0065382 | A1 * | 3/2010 | Beaudry | B66B 7/048 187/409 |

FOREIGN PATENT DOCUMENTS

| | | | | |
|---|---|---|---|---|
| CH | 513 074 | A | 11/1971 | |
| CN | 101139062 | A | 3/2008 | |
| DE | 2011942 | A1 * | 3/1970 | B66B 7/047 |
| DE | 2412397 | A1 * | 9/1974 | B66B 7/047 |
| DE | 7607776 | U1 | 7/1976 | |

(Continued)

OTHER PUBLICATIONS

EPO, Machine Translation, DE 2412397 A1, Jun. 6, 2015, pp. 1-5.*
EPO, Machine Translation, DE 3919850 A1, Dec. 17, 2012, p. 1-4.*

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

A sliding guide shoe includes at least a body part, which includes at least a slide pad space for a slide pad as well as at least one fixing part for fixing the sliding guide shoe to its base. The body part is essentially the same in its cross-sectional profile throughout its whole length. An elevator is also provided with the sliding guide shoe.

18 Claims, 3 Drawing Sheets

(56) References Cited

FOREIGN PATENT DOCUMENTS

Figure 1:
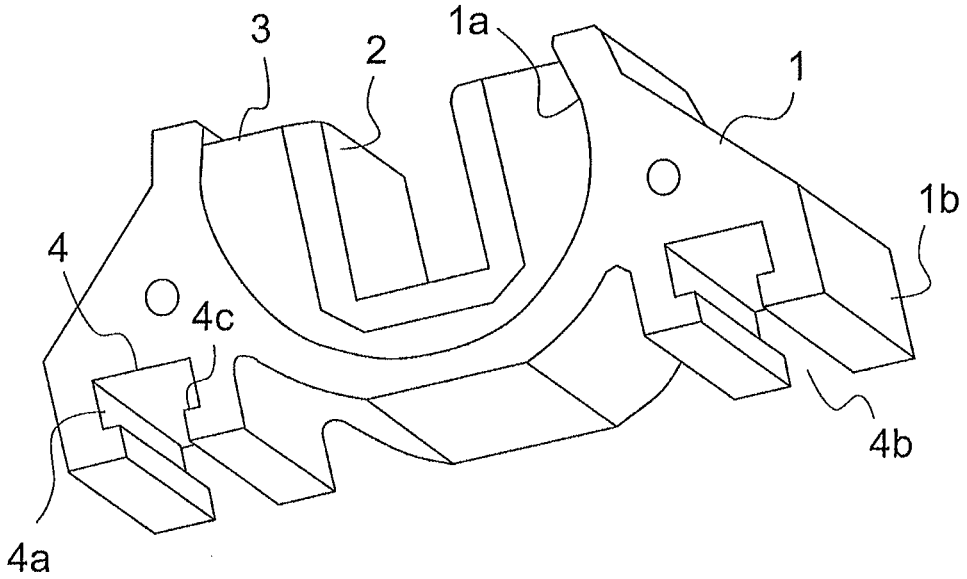

| | | | | | |
|---|---|---|---|---|---|
| DE | 3919850 | A1 * | 12/1989 | ..... | B66B 7/047 |
| DE | 29713032 | U1 * | 9/1997 | ..... | B66B 7/047 |
| DE | 202010000849 | U1 * | 6/2011 | ..... | B66B 7/047 |
| JP | S50-018975 | B1 | 7/1975 | | |
| JP | 51-038881 | U | 3/1976 | | |
| JP | H4-009873 | U | 1/1992 | | |
| JP | 2810222 | B2 * | 10/1998 | ..... | B66B 7/047 |
| JP | 11-209029 | A | 8/1999 | | |

* cited by examiner

SLIDING GUIDE SHOE AND AN ELEVATOR PROVIDED WITH A SLIDING GUIDE SHOE

CROSS REFERENCE TO RELATED APPLICATIONS

This application is a Bypass Continuation of PCT International Application No. PCT/FI2011/050659 filed on Jul. 15, 2011, which claims priority under 35 U.S.C. §119(a) to Patent Application No. 20105853 filed in Finland on Aug. 16, 2010, all of which are hereby expressly incorporated by reference into the present application.

The present invention relates to a sliding guide shoe of an elevator as presented in the preamble of claim 1 and an elevator provided with a sliding guide shoe as presented in the preamble of claim 12.

Normally elevators comprise essentially vertical guide rails disposed in an elevator hoistway, guided by which guide rails the elevator car is fitted to travel up and down in the elevator hoistway. Guide shoes are fitted onto the top edges and bottom edges of the elevator car or of the car sling, which guide shoes are arranged to guide the passage of the car on the guide rails. The most commonly used types of guide shoes are a sliding guide shoe and a roller guide shoe. The current invention relates to a sliding guide shoe.

According to prior art the body of a sliding guide shoe is e.g. is cast or bent from metal, and various additional parts, e.g. for fixing the body to the elevator car or to the car sling, are fixed to the body. Fixing additional parts is laborious and time-consuming, and therefore raises the price of a sliding guide shoe. Additionally, if the fixing of the fixing parts to the body is not sufficiently precise, the imprecision might cause extra vibration and noise when the elevator car travels. This type of vibration and noise might also be transmitted visa the guide rails to the elevator car, which disturbs the passengers.

The purpose of this invention is to eliminate the aforementioned drawbacks and to achieve a sliding guide shoe, which is easy and quick to manufacture precisely, and thus to prevent the vibrations and noise produced by, inter alia, the guide shoe and the guide rail from being transmitted to the elevator car. Another aim is to achieve an elevator, the sliding guide shoes of which are structurally simple and also inexpensive, and their structure is such that they are easy to install into position. The sliding guide shoe of the invention is characterized by what is disclosed in the characterization part of claim 1. Correspondingly, the elevator according to the invention is characterized by what is disclosed in the characterization part of claim 12. Other embodiments of the invention are characterized by what is disclosed in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments. In addition it can be stated that at least some of the subordinate claims can in at least some situations be deemed to be inventive in their own right.

One advantage of the sliding guide shoe according to the invention is that the sliding guide shoe is easy, quick and inexpensive to manufacture, because other metal parts do not necessarily need to be fixed to the body part, and the body part can be manufactured by cutting it to its suitable length from a long profile bar. Likewise, one advantage is that the sliding guide shoe is quick and easy to fix into its position by sliding. Correspondingly, an advantage of the elevator according to the invention is that owing to the good manufacturing precision of the sliding guide shoe the vibrations and noise produced in elevator use by the guide shoes of guide rails and of the car can be reduced.

In one basic embodiment of the concept according to the invention the sliding guide shoe of an elevator comprises at least a body part, which comprises at least a slide pad space for a slide pad as well as at least one fixing part for fixing the sliding guide shoe to its base. The body part is essentially the same in its cross-sectional profile throughout its whole length.

Preferably the fixing part comprises a profile groove of the length of the fixing part, which profile groove is essentially the same in its cross-sectional profile throughout its whole length. The longitudinal placement of the sliding guide shoe when fixing is thus simple. Installation of the sliding guide shoe can thus be implemented simply, e.g. by sliding the sliding guide shoe in relation to the fixing means or fixing base to be placed into the profile groove. In this way the manufacture, structure and installation of the body of a sliding guide shoe can all be based on the longitudinal continuity of the sliding guide shoe. The fixing shapes are thus also very simple to manufacture.

The slide pad space and a possible profile groove are each open in the longitudinal directions of the body part. If the reliability of the structure so requires, end structures can be fixed to the ends of them.

Preferably the slide pad space is a trough-shaped slide pad space opening in the transverse direction of the body part, more particularly towards the front in the direction of the guide rail.

Preferably the fixing part of the sliding guide shoe is essentially the same in its cross-sectional profile for the whole length of the body part of the sliding guide shoe.

Preferably the fixing part comprises a profile groove of the length of the fixing part, which profile groove opens towards the transverse direction of the body part, preferably towards its mounting base. Via the profile groove the fixing part is simple to fix into its position on a structure of the elevator car.

Preferably the profile groove opens in the opposite direction to the slide pad space.

Preferably the profile groove is a T-groove in its cross-section. In this way the head of a bolt or corresponding fixing means can be locked inside it.

Preferably the profile groove is a groove, preferably a T-groove in its cross-section, which groove opens in the opposite direction to the slide pad space.

Preferably the profile groove is rectangular in its cross-sectional shape, and opens on both sides of the body part in the side direction of the sliding guide shoe.

Preferably the body part of the sliding guide shoe is an integral piece of a single material.

Preferably the body part of the sliding guide shoe is an extruded piece. Thus the same sliding guide shoe body part can be manufactured simply to be continuously the same in its cross-section and to comprise the aforementioned slide pad space, and preferably also other shapes, most preferably for the fixing of the aforementioned profile groove(s).

Preferably a structure comprising a slide pad is fitted into the slide pad space, and that the structure comprising a slide pad comprises a curved surface, which with the curved surface comprised in the slide pad space forms a corresponding pair, for enabling the rotation of the structure comprising the slide pad and of the slide pad space in relation to each other in the longitudinal direction of the sliding guide shoe. This type of structure is particularly advantageous when extrusion is the manufacturing method, because in this way a simple shape can be produced for the slide pad space and a simple fixing for the structure comprising the slide pad with few fixing means or even with no fixing means at all. The curvation of the aforementioned curved surface is preferably of a constant radius.

Preferably the body part of the sliding guide shoe is in its material of aluminium or of a metal alloy containing aluminium, or some other material suited to extrusion.

Preferably the body part of the sliding guide shoe is a piece cut to the desired length from prefabricated profile bar. Thus the sliding guide shoe body can be manufactured simply, which body is continuously the same in its cross-section, and comprises the aforementioned slide pad space, and preferably also other shapes, most preferably for the fixing of the aforementioned profile groove.

In one basic embodiment of the concept according to the invention the elevator comprises at least an elevator car that is provided with a sliding guide shoe and that is arranged to move along guide rails, which sliding guide shoe comprises at least a body part, which comprises at least a slide pad space for a slide pad as well as at least one fixing part for fixing the sliding guide shoe to its base. The body part of the sliding guide shoe is essentially the same in its cross-sectional profile throughout its whole length. Preferably the sliding guide shoe of an elevator is one of the types described above.

Preferably the slide pad space opens towards the guide rail of the elevator car, and that the fixing part comprises a profile groove at least essentially of the length of the fixing part, which profile groove opens in the transverse direction of the body part, preferably to the rear or to the side, towards its mounting base. Installing the sliding guide shoe can thus be implemented simply, e.g. by sliding the sliding guide shoe in relation to the fixing means or mounting base to be placed into the profile groove.

Preferably the fixing part comprises a profile groove of at least essentially the length of the fixing part, which profile groove opens towards its mounting base, and the aforementioned sliding guide shoe is fixed to its mounting base such that a part of the mounting base and/or a part of the fixing means extends into the profile groove. Installation of the sliding guide shoe can thus be implemented simply. It can be slid in the longitudinal direction in relation to the aforementioned mounting base and/or fixing means in the profile groove, which direction corresponds to the longitudinal direction of the guide rail in connection with the fixing. The structure can thus be formed to be compact. The sliding guide shoe can thus be installed into a space into which its tightening would otherwise be impossible.

Figure 2:
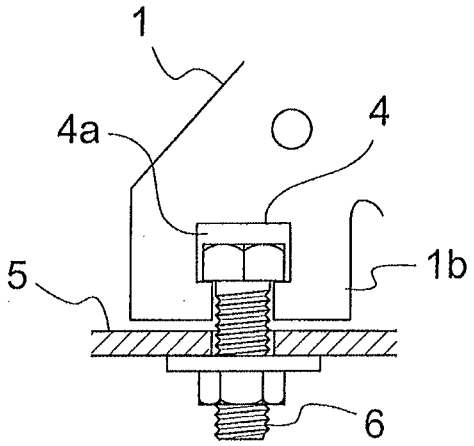
Figure 3:
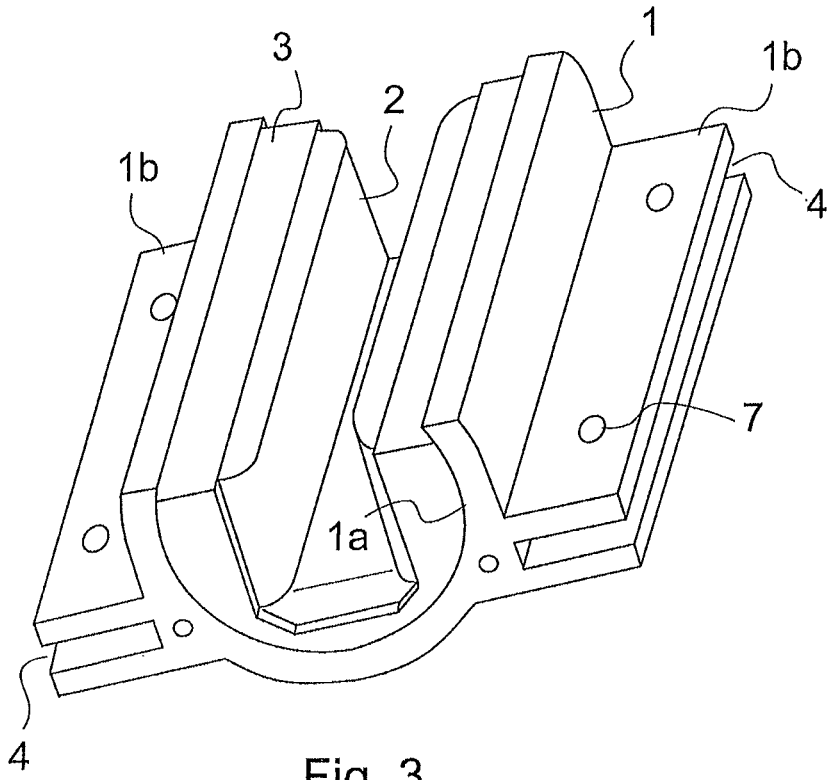
Figure 4:
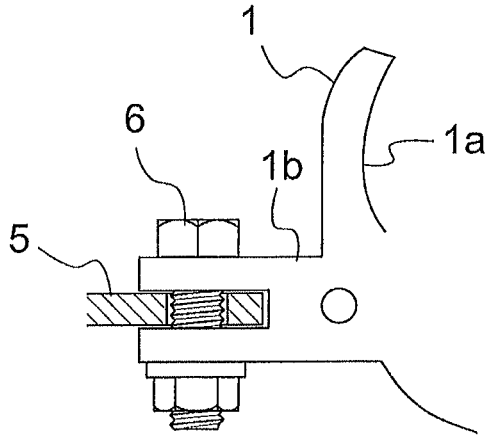
Figure 5:
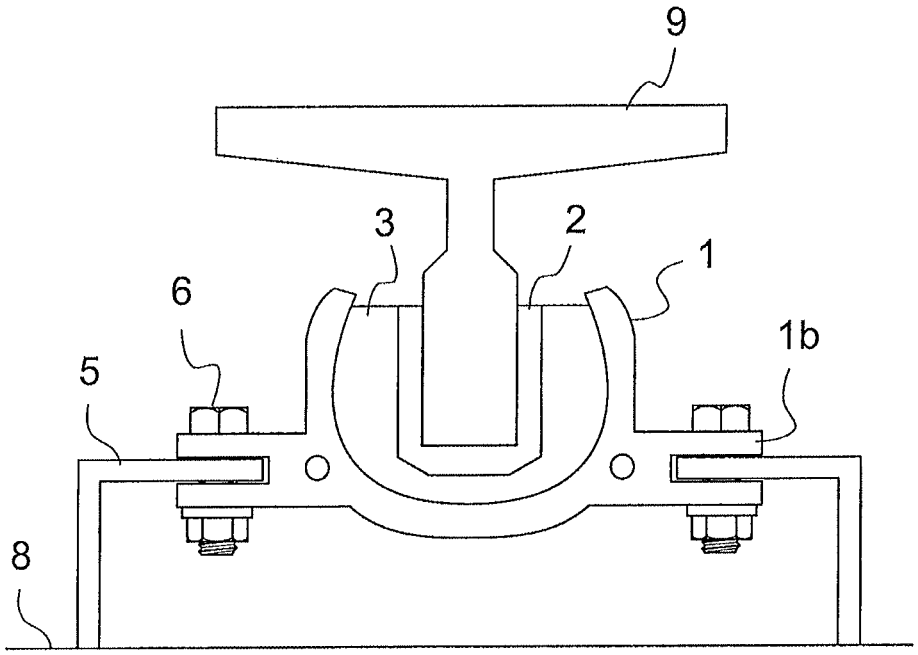

In the following, the invention will be described in greater detail by the aid of some examples of its embodiment with reference to the attached drawings, wherein FIG. 1 presents an oblique bottom view of a sliding guide shoe according to the invention, FIG. 2 presents one detail of a sliding guide shoe according to the invention, as viewed from the end, FIG. 3 presents an oblique top view of a second sliding guide shoe according to the invention, FIG. 4 presents one detail of a sliding guide shoe according to FIG. 3, as viewed from the end, FIG. 5 presents a sliding guide shoe according to FIG. 3, as viewed from the end, with a guide rail and fixed to the elevator car.

FIG. 1 presents one sliding guide shoe according to the invention, which comprises a body part 1, which comprises a trough-shaped slide pad space 1*a* that is curved in its cross-section and that opens towards the front, i.e. towards the guide rail of the elevator car, and two fixing parts 1*b* on the sides. The actual slide pad 2 that damps trembling and vibration is fixed into the slide pad space 1*a* via a frontward-opening trough-shaped insulating part 3, which insulating part 3 is e.g. an elastomer, which is supported on the curved surface of the slide pad space 1*a*. The slide pad 2 is e.g. glued to the insulating part 3.

The fixing parts 1*b* of the body part are of essentially the full length of the body part 1 and the fixing parts 1*b* comprise a profile groove 4 that is the length of the body part 1 and that opens towards the rear for fixing the sliding guide shoe. The profile groove 4 is in its cross-section e.g. a typical T-groove, which comprises a broader section 4*a* for the head of a fixing screw and a narrower section 4*b* for the screw part, which narrower section extends from the broader section up to the rear surface of the body part and opens to behind the body part, i.e. in the opposite direction to the slide pad space 1*a*. The broader section 4*a* and the narrower section 4*b* are symmetrical to each other such that a support surface 4*c* remains between them on both sides of the narrower section for the head of a fixing screw.

FIG. 2 presents in more detail one fixing part 1*b* of a sliding guide shoe according to the invention in a situation in which the sliding guide shoe is being fixed to its base, e.g. to a mounting base 5 on the elevator car or on the car sling. Fixing occurs e.g. such that the sliding guide shoe is slid in the direction of its profile grooves 4 on top of the heads of the fixing screws 4 such that the heads of the preliminarily and loosely fixed fixing screws 6 remain inside the broader section 4*a* of the profile grooves 4. When the sliding guide shoe is at its correct point, the fixing screws 6 are tightened to their final tightness. Thus the fixing is easy, fast and dimensionally accurate.

FIG. 3 presents one second sliding guide shoe according to the invention, which comprises a body part 1, which comprises a trough-shaped slide pad space 1*a* that is curved in its cross-section and that opens towards the front, i.e. towards the guide rail of the elevator car, and two fixing parts 1*b* on the sides. The actual slide pad 2 that damps trembling and vibration is fixed into the slide pad space 1*a* via a frontward-opening trough-shaped insulating part 3, which insulating part 3 is e.g. an elastomer, which is supported on the curved surface of the slide pad space 1*a*. The slide pad 2 is e.g. glued to the insulating part 3.

The fixing parts 1*b* that are on both sides of the body part 1 and that extend in a lateral direction are of essentially the full length of the body part 1 and both fixing parts 1*b* comprise a profile groove 4 that is of the length of the body part 1 and that opens to the side of the body part 1 for fixing the sliding guide shoe. The profile groove 4 is e.g. a groove of rectangular shape in its cross-section, which opens to a side of the body part. In addition, the fixing part 1*b* comprises fixing holes 7 for fixing the sliding guide shoe to its base, such as to the elevator car or to the car sling of the elevator.

FIG. 4 presents in more detail a fixing part 1*b* of a sliding guide shoe according to FIG. 2 in a situation, in which the sliding guide shoe is being fixed to its base, e.g. to a mounting base 5 on the elevator car or on the car sling. Fixing occurs e.g. such that the sliding guide shoe is slid in the direction of its profile grooves 4 along its mounting base 5 such that the mounting base 5 is inside each profile groove 4, until the sliding guide shoe is at the correct point in its mounting base 5. When the sliding guide shoe is at its correct point, the fixing screws 6 are tightened to their final tightness. Thus the fixing is easy, fast and dimensionally accurate.

It is characteristic to the sliding guide shoe according to the invention that, inter alia, the body part 1 of the sliding guide shoe with the slide pad space 1*a* and fixing parts 1*b* is a profile piece made in the desired shape in terms of its cross-section, which profile piece is essentially the same in its cross-sectional profile throughout its whole length. Possible holes or machinings made afterwards in the body part 1 are not deemed to belong to the cross-sectional profile of the body part. The body part 1 of the sliding guide shoe is in its material e.g. of extruded aluminium or of some other metal alloy containing aluminium and suited to extrusion. Thus body parts 1 are quick, easy and inexpensive to manufacture by cutting pieces of suitable length from prefabricated profile, which pieces are already sufficiently precise in their dimensions for their purpose without additional machining. Since the body part 1 is an integral (monolithic) piece of a single material, it is simple to manufacture as a profile.

FIG. 5 presents a sliding guide shoe according to FIG. 3, as viewed from the end, fixed to the elevator car 8 via its mounting base 5. The guide surfaces of the guide rail 9 of the elevator, guided by which the elevator car 8 moves, are fitted inside the slide pad 2 of the sliding guide shoe. Although in FIG. 5 the mounting base 5 is fixed directly to the elevator car 8, it can also just as well be fixed to the sling of the elevator car.

The elevator according to the invention comprises any of the type of guide shoe described above, which guide shoe is fixed to its mounting base in the manner presented in FIG. 2, 4 or 5. In this case in the fixing phase of the guide shoe, it was possible to slide the guide shoe in the longitudinal direction into its position, which longitudinal direction corresponds to the direction of movement of the elevator car, i.e. to the longitudinal direction of the guide rail guiding the elevator car by means of the guide shoe. The body part 1 is thus in the direction of movement of the elevator car essentially the same in its cross-sectional profile throughout its whole length. In this way the installation, replacement and servicing of the guide shoe can be performed quickly despite the cramped lateral space.

In the above, extrusion is mentioned as the preferred manufacturing technology. At least some of the stated advantages can also, however, be achieved if the body part is manufactured by casting.

The preferred material of the body part 1 is metal; owing to its lightness most preferably aluminium or an alloy of it. The body part can, however, be made from some other material. One preferred lightweight alternative is an extruded or cast material containing polymer. The material can in this case be a composite material reinforced with fibers, such as with synthetic fibers (e.g. glass fiber, carbon fiber or aramid fiber) or with aluminium fibers, in which case the part can be formed to be very light in weight.

The sliding guide shoe according to the invention would be suited as a guide shoe to many other applications than the guiding of an elevator car or of a counterweight that is described above, including inter alia sliding doors and sliding windows, as well as various other structures that are moved while supported by sliding guide shoes.

It is presented above that a structure 2,3 comprising a slide pad 2 is fitted into the slide pad space, which structure comprises an elastomeric insulating part 3 suited to the slide pad space. As presented, the structure 2,3 comprising a slide pad 2, i.e. more precisely the part 3, preferably has a curved backing such that the backing surface possesses the shape of a cylinder segment of constant radius. The shape of the slide pad space is a corresponding pair for this shape, so that the structure 2,3 is able to rotate in the slide pad space around the longitudinal axis of the profile, an advantage of which is the favorable adaptation of the guide shoe in relation to the guide rail at the point of the guide shoe at any given time. Since rotation is not necessary, the slide pad space and the structure 2,3 could also, however, possess profiles that form other types of corresponding pairs.

It is obvious to the person skilled in the art that different embodiments of the invention are not only limited to the examples described above, but that they may be varied within the scope of the claims presented below. Thus, for example, the cross-sectional shape of the body part of the sliding guide shoe can vary to what is presented above and the fixing parts can also be different to what is described above. Although a sliding guide shoe in elevator use is presented as an example, a sliding guide shoe according to the invention can be used also elsewhere than in elevator use.

The invention claimed is:

1. A sliding guide shoe of an elevator, the sliding guide shoe comprising:

a body part, the body part defining a slide pad space and having at least one fixing part for fixing the sliding guide shoe to a base, the fixing part including a profile groove configured to receive a portion of the base therein or to receive a portion of a fastener to mount the body part to the base, the body part having essentially a same cross-sectional profile throughout a length of the body part;

an insulating part located in the slide pad space; and a slide pad mounted to the insulating part, the sliding pad defining a space to receive a guide rail of an elevator, wherein the body part, including the at least one fixing part, is an integral piece of a single material.

2. The sliding guide shoe according to claim 1, wherein the slide pad space has an opening facing a transverse direction of the body part.

3. The sliding guide shoe according to claim 2, wherein the profile groove has an open end facing in an opposite direction to the slide pad space, and the profile groove is T-shaped in cross-section.

4. The sliding guide shoe according to claim 2, wherein the fixing part of the sliding guide shoe has essentially a same cross-sectional profile for throughout a length of the body part.

5. The sliding guide shoe according to claim 1, wherein the profile groove has an open end facing a transverse direction of the body part.

6. The sliding guide shoe according to claim 5, wherein the fixing part of the sliding guide shoe has essentially a same cross-sectional profile for throughout a length of the body part.

7. The sliding guide shoe according to claim 5, wherein the slide pad space has an open end that face a transverse direction of the body part.

8. The sliding guide shoe according to claim 1, wherein the fixing part of the sliding guide shoe has essentially a same cross-sectional profile throughout a length of the body part.

9. The sliding guide shoe according to claim 1, wherein the profile groove extends a length of the fixing part, the profile groove having an open end facing the mounting base.

10. The sliding guide shoe according to claim 1, wherein the profile groove extends a length of the fixing part, the profile groove has essentially a same cross-sectional profile.

11. The sliding guide shoe according to claim 1, wherein the at least one fixing part is a pair of fixing parts arranged at opposites sides of the body, and the profile groove of each fixing part having a rectangular cross-sectional shape.

12. The sliding guide shoe according to claim 1, wherein the body part of the sliding guide shoe is an extruded piece.

13. The sliding guide shoe according to claim 1, wherein the insulated part is fitted into the slide pad space, and the insulated part has a curved surface corresponding to a curved surface of the body part defining the slide pad space.

14. The sliding guide shoe according to claim 1, wherein the body part of the sliding guide shoe is formed of aluminum or of a metal alloy containing aluminum.

15. The sliding guide shoe according to claim 1, wherein the body part of the sliding guide shoe is a piece cut from a prefabricated profile bar.

16. An elevator comprising:

a plurality of guide rails;

an elevator car; and a sliding guide shoe to slidably connect the elevator to one guide rail of the plurality of guide rails, the sliding guide shoe comprising:

a body part, the body part defining a slide pad space and having a fixing part for fixing the sliding guide shoe to a base, the fixing part including a profile groove configured to receive a portion of the base therein or to receive a portion of a fastener to mount the body part to the base, the body part having essentially a same cross-sectional profile throughout a length of the body part;

an insulating part located in the slide pad space; and a slide pad mounted to the insulating part, the sliding pad defining a space to receive the one guide rail of the plurality of guide rails, wherein the body part, including the fixing part, is an integral piece of a single material.

17. The elevator according to claim 16, wherein the slide pad space has an open end facing towards the guide rail of the elevator car, and wherein the profile groove having a length essentially equal to a length of the fixing part, the profile groove having an open end that faces a transverse direction of the body part toward the mounting base.

18. The elevator according to claim 16, wherein the profile groove having a length essentially equal to a length of the fixing part, the profile groove having an open end that faces the mounting base.

* * * * *